US007934517B2

(12) United States Patent
Morrison

(10) Patent No.: US 7,934,517 B2
(45) Date of Patent: May 3, 2011

(54) WATER LEVEL CONTROL SYSTEM

(75) Inventor: Dan Morrison, Anaheim, CA (US)

(73) Assignee: MP Industries, Inc., Huntington Beach, CA (US)

( * ) Notice: Subject to any disclaimer, the term of this patent is extended or adjusted under 35 U.S.C. 154(b) by 138 days.

(21) Appl. No.: 12/005,935

(22) Filed: Dec. 28, 2007

(65) Prior Publication Data

US 2009/0165202 A1 Jul. 2, 2009

(51) Int. Cl.
*F16K 31/18* (2006.01)

(52) U.S. Cl. ..... 137/428; 4/508

(58) Field of Classification Search ..... 137/386, 137/397, 398, 409, 428, 434, 425; 4/508; 73/305; 210/167.1
See application file for complete search history.

(56) References Cited

U.S. PATENT DOCUMENTS 2,739,939 A * 3/1956 Leslie ..... 210/127
2,809,752 A * 10/1957 Leslie ..... 210/127
3,618,774 A * 11/1971 Delphia ..... 210/128
4,342,125 A * 8/1982 Hodge ..... 4/508
4,706,310 A 11/1987 Magnes ..... 4/508
5,367,723 A 11/1994 Pleva et al. ..... 4/508
5,596,773 A 1/1997 Cueman ..... 4/508
5,720,056 A * 2/1998 Aymes ..... 4/488
5,790,991 A * 8/1998 Johnson ..... 4/508
6,035,879 A * 3/2000 Campbell et al. ..... 137/15.08

* cited by examiner

*Primary Examiner* — Craig M Schneider
(74) *Attorney, Agent, or Firm* — Koppel, Patrick, Heybl & Dawson

(57) ABSTRACT

Systems for controlling the level of water with in reservoir, such as in a catch basin for an infinity pool. One embodiment of such a water level control system comprises a system housing having a removable front plate with front plate openings, and a water inlet into the housing. The system further comprises a removable mounting plate within the housing, with the mounting plate removable from the housing when the front plate is removed. A valve is included that is connected to the mounting plate, with water from the reservoir entering the housing through the front plate openings. The valve is operable to allow water to flow into the housing through the water inlet when water within the reservoir water falls below a desired level, and stopping the flow into the housing when the reservoir is at the desired level.

8 Claims, 3 Drawing Sheets

WATER LEVEL CONTROL SYSTEM

BACKGROUND OF THE INVENTION

1. Field of the Invention

This invention relates to pools, and more particularly water level control systems for infinity pool catch basins.

2. Description of the Related Art

Various systems and devices have been developed for controlling the water level on a pool or spa. For example, U.S. Pat. No. 4,706,310 discloses a liquid level control system which can be installed within an automatic pool reservoir surface skimmer or separately within or external of the reservoir, which includes a primary float valve, which allows liquid to flow into a pool reservoir when the level of fluid in the reservoir falls below a first predetermined level and a secondary float valve associated with the primary flow valve, which shuts off the flow of liquid into the pool reservoir when the level of the liquid exceeds a second predetermined level, which is higher in elevation than the first predetermined level. The primary float valve continually operates between open and closed states. The secondary valve is normally in an open state and when caused to change to a closed state remains in a closed state until manually reset. A flow valve is included which terminates flow from the source of the liquid under pressure to the reservoir through the liquid level control system when a normally expected flow rate is exceeded. A novel triangular shaped supply line for liquid under pressure is provided for reservoir level control add on. Several different liquid supply line embodiments are shown.

U.S. Pat. No. 5,367,723 discloses a valve apparatus for regulating the water level in a swimming pool. The apparatus is mounted in a surge pit remote from the pool. The apparatus includes first and second valves movable between open and closed positions for controlling the introduction of water into the surge pit from the main drain line and from a fresh water supply line, respectively. The first and second valves are operatively interconnected and are moved between their open and closed positions by a float member in the surge pit. As the water level in the pool drops below an ideal level wherein a thin layer of water skims over the lip of the gutter system, less water is provided to the surge pit from the gutter drain line, such that the water level in the pit drops, and causing the float member to drop so as to open the first and second valves to allow more water into the surge pit from the main drain line of the pool and from the fresh water supply line. Conversely, as the water level in the pool rises above an ideal level, excess water from the gutter drain line is supplied to the pit, thereby raising the water level therein, and raising the float member so as to close the first and second valves, thereby decreasing the flow of water from the main drain line and from the fresh water supply line.

U.S. Pat. No. 5,596,773 discloses portable swimming pool water level maintenance device for releasable attachment to a swimming pool having a built-in skimmer. The device includes an upright conduit open at each end and having a conventional toilet ball cock valve and vertically slidable float assembly mounted therewithin. The water inlet of the valve is connectable to the water discharge end of a garden hose, fill water being supplied from the garden hose through the valve to raise the water level sufficiently for the float to close the valve. The conduit is held in upright orientation and vertical position by three spaced, parallel elongated horizontal support members and an elongated upright support member connected to the side of the conduit and arranged to releasably engage against the deck, inside upper surface of the skimmer and the pool wall surface just below the skimmer. A small visual flow outlet discharges some of the water flowing into the valve out from above the pool water level to visually advise of when the valve is open and the pool is being filled.

Infinity pools or spas have gained more popularity in recent years, with an infinity pool (also named negative edge or vanishing edge pool) being a swimming pool which produces a visual effect of water extending to the horizon, vanishing, or extending to "infinity". In reality the far edge of the pool (with the view in the background) terminates in a weir that is typically one-half to one inch (12 mm to 25 mm) lower than the required median pool water level. A trough, catchment area or catch basin is constructed below the weir, with water spilling into it where it is then pumped back into the pool. When the timer-operated pool recirculation system stops, the median pool level drains down to the weir level, the lost water being collected into the catch basis. The catch basin area typically must be large enough in volume to contain this amount of pool water, and to cope with additional water from rainfall. When the recirculation system re-starts, water is first drawn from the catchment area and piped back into the pool at such a rate that the pool water level rises to allow the process to begin all over.

Typically, these pools are fitted with a constant water top-up device or water level control device, as the flow of water over the weir effectively introduces significant water loss by way of transpiration or evaporation. A conventional top-up device similar to a common toilet refill device is usually included with the pool, to keep the pool water constantly high enough to allow the visual effect to continue. These devices are typically provided as systems separate from the pool and its catch basin, and these systems can be unsightly and can consume additional space around the pool.

SUMMARY OF THE INVENTION

The invention is generally directed to different embodiments of systems for controlling the level of water within a reservoir, with the invention adapted for use in controlling the level of water within an infinity pool catch basin.

One embodiment of a water level control system according to the present invention for controlling the level of water in a reservoir comprises a system housing having a removable front plate with front plate openings, and a water inlet into the housing. The system further comprises a removable mounting plate within the housing, with the mounting plate removable from the housing when the front plate is removed. A valve is included that is connected to the mounting plate, with water from the reservoir entering the housing through the front plate openings. The valve is operable to allow water to flow into the housing through the water inlet when water within the reservoir water falls below a desired level, and stopping the flow into the housing when the reservoir is at the desired level.

Another embodiment of a water level control system for controlling the level of water in a reservoir according to the present invention comprises a system housing having a front plate with front plate openings, with the housing further comprising a water inlet. A valve is arranged within the housing, with from the reservoir entering the housing through the front plate openings. The valve is operable to allow water to flow into the housing through the water inlet and into the reservoir, when water within the reservoir falls below a desired level. The flow into the housing is stopped when the reservoir is at the desired level.

The systems according to the present invention can also be used in a variety of pools. On embodiment of an infinite pool according to the present invention comprises a reservoir of water with a catch basin, with water running from the reservoir to the catch basin. A conduit is included for returning water from the catch basin to the reservoir. A water level control system is included in a wall of the catch basin that comprises, a system housing having a front plate with front plate openings. The housing further comprises a water inlet to allow water from an external source into the housing. A valve is arranged within the housing, with water from the catch basin entering the housing through the front plate openings. The valve is operable to allow water to flow into the housing through the water inlet and into the catch basin through the front plate opening, when water within the reservoir falls below a desired level. The flow into the housing is stopple when the reservoir is at the desired level.

These and other aspects and advantages of the invention will become apparent from the following detailed description and the accompanying drawings which illustrate by way of example the features of the invention.

DETAILED DESCRIPTION OF THE INVENTION

Figure 1:
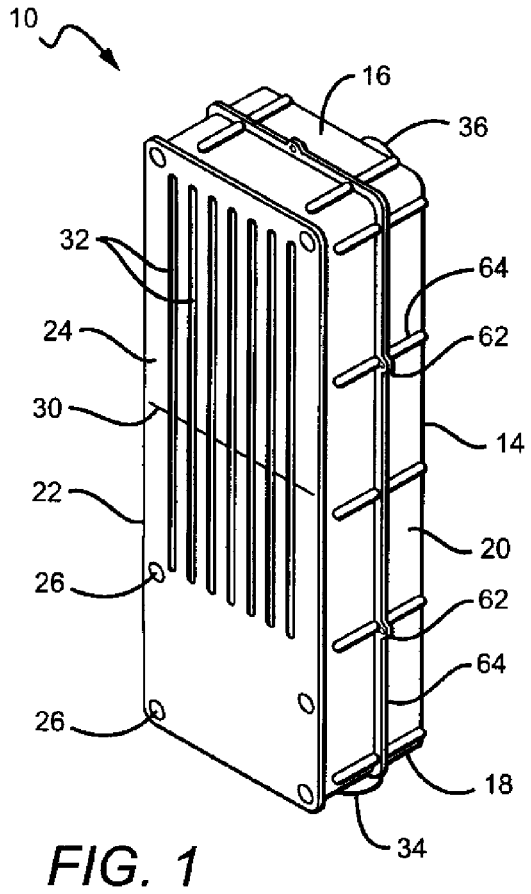
FIG. 1 is a front perspective of one embodiment of a catch basin water level control system according to the present invention.
Figure 2:
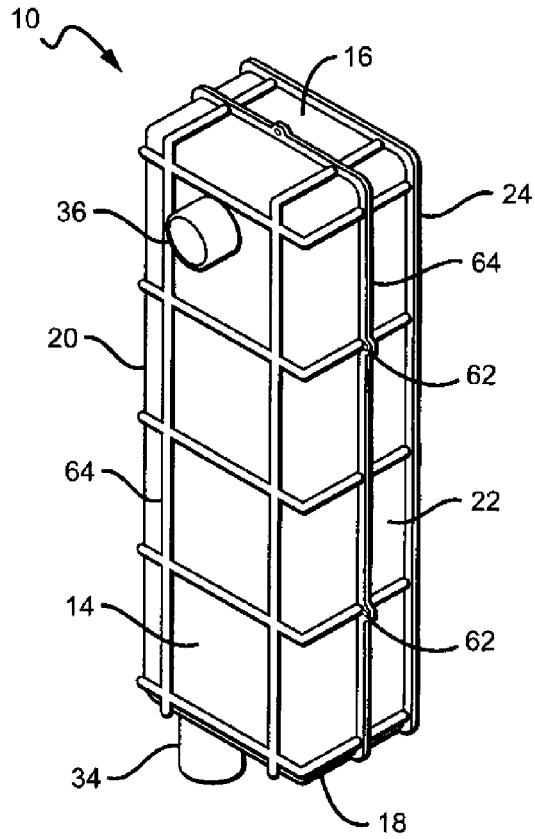
FIG. 2 is an back perspective view of the system shown in FIG. 1.

The present invention relates generally to improved infinity pool catch basin water level control systems, and in particular to such systems that are built into one of the surfaces of the pool near the catch basin. In one embodiment according to the present invention, the level control system is built into one of the gunite surfaces by being mounted to rebar within the surface prior to introduction of the gunite material in such a way that following formation of the surface, the system is embedded in the gunite surface with the front surface of the system being substantially flush with the gunite surface. The water level control systems according to the present invention can be formed integral to the pool structure, and a separate water level device, that can be unsightly and can require additional space, is not needed.

The water level control systems according to the present invention are compact, reliable and incorporate improved arrangements for operation and maintenance. For example, the internal components of water level control system can be adjusted to adjust the level of water that is maintained in the catch basin. The systems are also arranged for easy access to the internal components, allowing access to the components for adjustment, maintenance and replacement in the event of failure of one or more of the internal components. The components are preferably made of materials that are compatible with and resist deterioration from chemicals and compounds encountered in a typical pool.

The present invention is described herein with reference to certain embodiments but it is understood that the invention can be embodied in many different forms and should not be construed as limited to the embodiments set forth herein. In particular, the present invention is described below in regards to catch basin water level control systems, but the level control systems can be used in many applications other than catch basins. The present invention is also described as being mounted in a particular way and in a particular location within a pool, but it is understood that it can be mounted in many different locations in many different ways. The present invention is also described with reference to certain features arranged in certain ways, but it is also understood that the features can be arranged differently and different features can also be used.

It is also understood that when an element is referred to as being "on" or "connected to" another element, it can be directly on the other element or intervening elements may also be present. Furthermore, relative terms such as "inner", "outer", "upper", "above", "lower", "beneath", and "below", and similar terms, may be used herein to describe a relationship of one layer or another region. It is understood that these terms are intended to encompass different orientations of the device in addition to the orientation depicted in the figures.

Although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Embodiments of the invention are described herein with reference to certain view illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the regions illustrated herein but are to include deviations in shapes that result, for example, from manufacturing. Thus, the regions illustrated in the figures are schematic in nature and their shapes are not intended to illustrate the precise shape of a region of a device and are not intended to limit the scope of the invention.

The invention is now discussed with reference to certain embodiments. FIGS. 1-3 and 4 show one embodiment of a spa catch basin water level control system 10 ("control system") according to the present invention. The control system comprises a housing 12, having a back surface 14, top and bottom surfaces 16, 18, and first and second side surfaces 20, 22, that are integral to one another to form a space that holds the control system's internal components. The housing also comprises a removable front plate 24 sized to fit over the front of the housing 12 to enclose the control system's internal components within the housing. The front plate 24 can be mounted in place by many different devices such as screws, clamps, brackets and snaps, or by different compounds such as glues or epoxies. In the embodiment shown, the front plate 24 is mounted in place by six screws 26 that pass through front plate 24 and turn into screw holes 28. The housing 10 is shown as having a rectangular shape, but it is understood that other embodiments according to the present invention can have many different shapes, including square, circular, pentagon, hexagon, etc.

The front plate has a horizontal water level line 30 that is included to designate the desired water level of within the catch basin when the control system 10 is installed. That is, the pool installer mounts the control system 10 at a location relative to the catch basin so that the water level line 30 is at a height within the basin to correspond to the desired water level in the basin during operation. As further described below, the water level maintained in the catch basin can be adjusted by adjusting the control system's internal components.

The front plate 24 also has a plurality of openings 32 that are arranged to allow water to pass between the housing 12 and the catch basin. Water passes into housing 12 from the catch basin and operates on the control systems internal components. As more fully described below, when the water level in the basin is below the desired level, the control system 10 operates to introduce additional water to the interior of the housing 12 that then passes through the openings 32, into and filling the catch basin. As the level in the catch basin reaches the desired level, the internal components operate to stop the introduction of additional water. The openings 32 are shown as a plurality of vertical slots, but it is understood that they can comprise many different shapes in many different sizes.

The housing 12 further comprises a bottom inlet 34 arranged to allow water from an external source to pass into the housing 12, such as when the catch basin water is below the desired level. The inlet can be connected to an external water source by known mounting methods, with one suitable method being gluing or bonding. Top outlet 36 is also included to allow water out of the system 10 under overflow conditions, such as when the internal valve, (described below) malfunctions.

Figure 3:
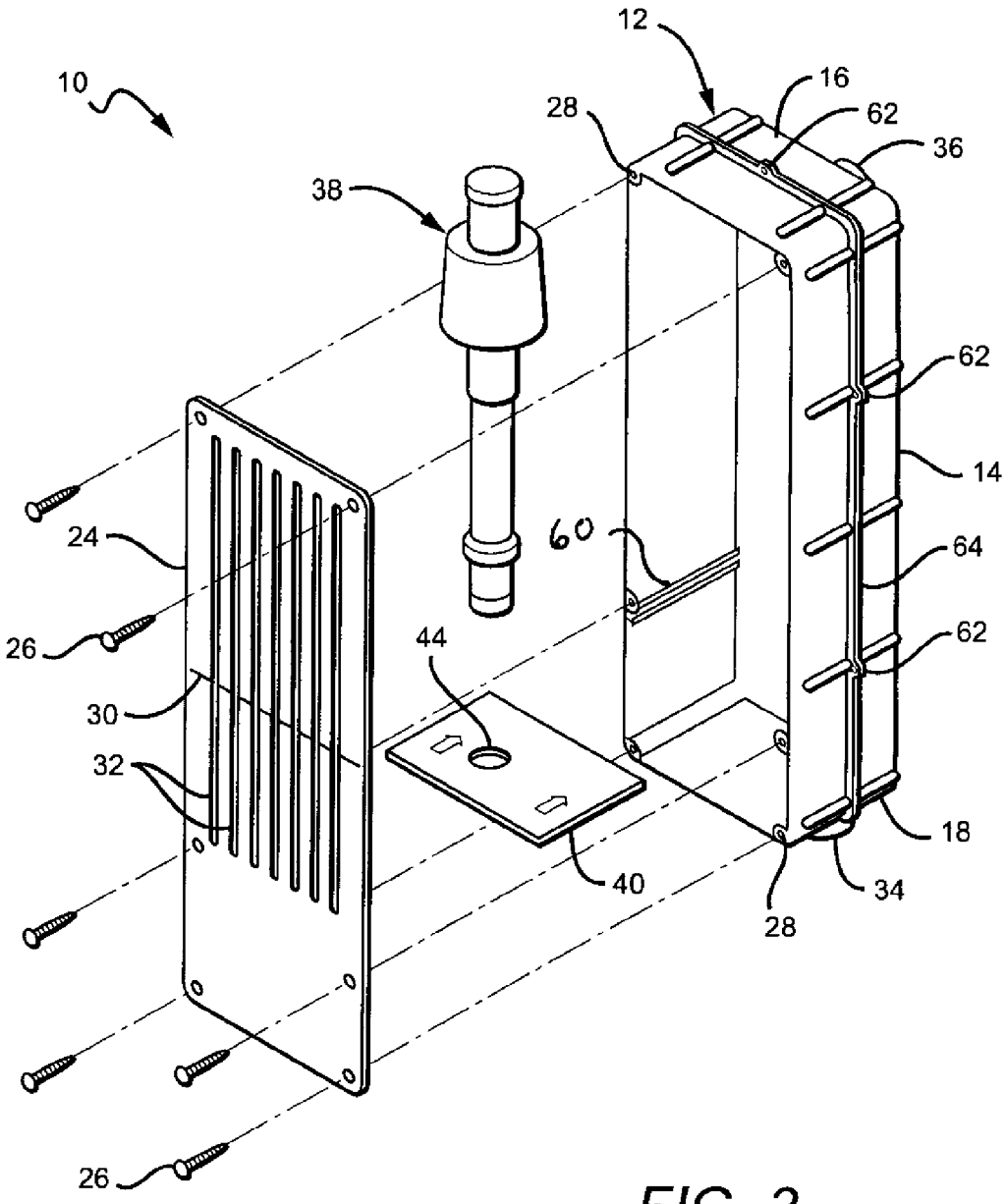
FIG. 3 is an exploded perspective view of the system shown in FIG. 1.
Figure 5:
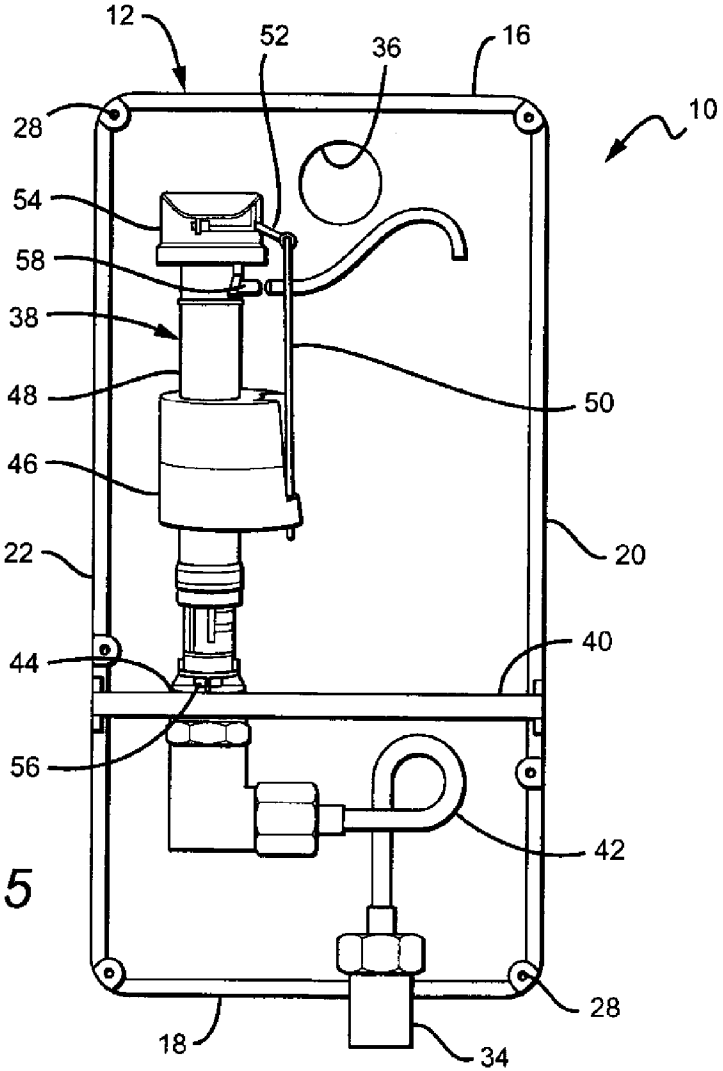
FIG. 5 is a front view of the water level control system shown in FIG. 1.
Figure 4:
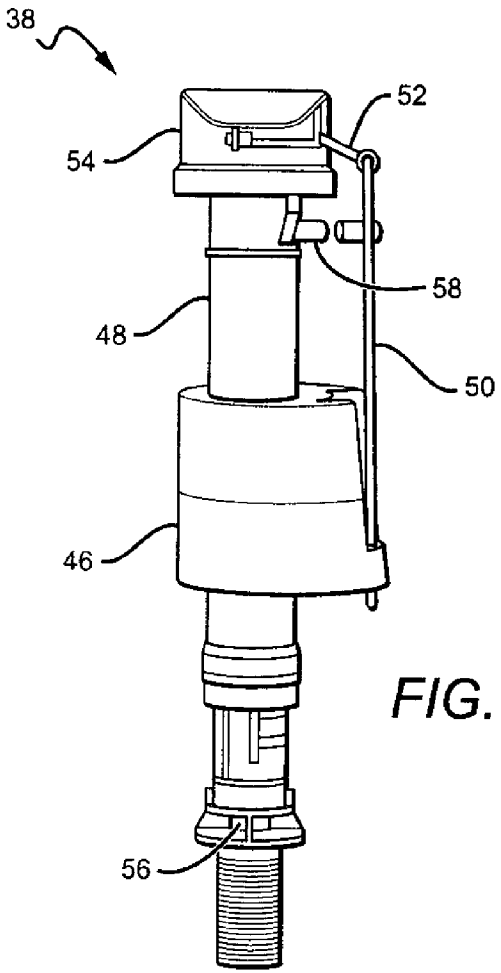
FIG. 4 is perspective view of one embodiment of a float valve that can be used in water level control systems according to the present invention.

Referring now to FIGS. 3-5, the internal components of the control system 10 are described and generally comprise a control valve 38, a valve mounting plate 40, and a connection tube 42 (shown in FIG. 5). The mounting plate 40 has an opening 44, and the control valve 38 is mounted to the plate 40 at its opening 44. The valve 38 can be mounted in many different orientations, with the preferred orientation being vertical. The tube 42 is mounted between the housing's bottom inlet 34 and the plate 40 at its opening 44, with the tube allowing water to pass from the inlet 34 to the interior of the valve 38.

The control valve 38 can comprise many different devices arranged in many different ways, with the control valve 38 shown comprising a float fill valve best shown in FIG. 4. One type of float valve that can be used with the present invention commercially known as Model 2000 Anti-Siphon Valve from Brass Craft, Inc. The valve 38 has a float 46 that rises and falls on the valve body 48 with the level of water in the housing 12 (and catch basin). When the water level and float 46 fall below the desired level, the connecting rod 50 causes the control lever 52 to open a valve within the cap 54. This allows water to pass from the tube 42 into housing 12 through the valve body's bottom openings 56 and top opening 58. Water that enters the housing 12 passes into the catch basin through the front plate openings 32, filling the catch basin. This continues until the water level in the catch basin rises to the desired level, at which point the connecting rod 50 causes the control lever to close the valve in the cap 54, discontinuing the flow of water into the housing.

In a preferred embodiment, the height of the control valve 38 is adjustable, to adjust the level of water at which additional water will be introduced through the inlet. As the height of the control valve 38 is increased, the float will be at a higher level, which will cause the valve to be actuated at a higher level. This in turn maintains the level of water to actuate the control valve at a higher level.

Referring back to FIG. 3, the mounting plate 40 is removable from the housing 12, by sliding it back along rails 60. This allows for the control valve 38 and the tube 42 to be easily accessed for adjustment, maintenance and replacement. In other embodiments, the mounting plate 40 can be fixed in place, or can have other means for removal.

The housing 12 can also comprise external mounting holes 62 that can be used for mounting the system 10 in place during installation. In the embodiment shown, the mounting holes are located and arranged to allow mounting to rebar prior to introducing gunite or other materials to form the surfaces of the pool. The mounting holes are located so that the front plate 24 is substantially flush with the surface of the gunite. This arrangement allows for the control system 10 to be mounted within a pool or spa in a flush and aesthetically pleasing manner. In the embodiment shown, the mounting holes 62 are particularly arranged to allow for mounting to rebar by passing a wire through each one or more of the holes 62 and wrapping the wire around the rebar. It is understood that the holes 62 can also be used for mounting the system 10 to items or devices other than rebar.

The system 10 can comprise ridges 64 integral to its outside surface arranged to strengthen the surfaces to weight from, for example, the gunite in the surfaces of the pool. The ridges can be arranged in many different locations and in many different ways, with the preferred ridges being raised sections formed of the same material as the housing, and formed integral to the housing during fabrication.

The housing 12 and its front plate 24, control valve 38, and mounting plate 40 can be made of different materials that are compatible with pool environments and should be salt, chlorine and ozone resistant. The suitable material is ABS or glass filled polypropylene, which are known in the art and can be fabricated using known processes such as injection molding. The connecting tube should also be made of a material that is salt, chlorine and ozone resistant and should also be flexible, with a suitable material being clear PVC with nylon reinforcements. The connection points, such as between the control valve 38 and the mounting plate 40, and the tube 42 and the mounting plate 40, can include a sealing member to create a watertight seal, such as by use of a rubber gasket or 0-ring. The rubber can be peroxide cured to make it more robust. The connection points can also have elements that are entirely or partially made of metal, with a suitable metal being stainless steel covered brass to also resist salt, chlorine and ozone. The screws 26 should be made of a material to resist corrosion encountered in typical pool and spa environments, with the suitable materials being brass or stainless steel.

Figure 6:
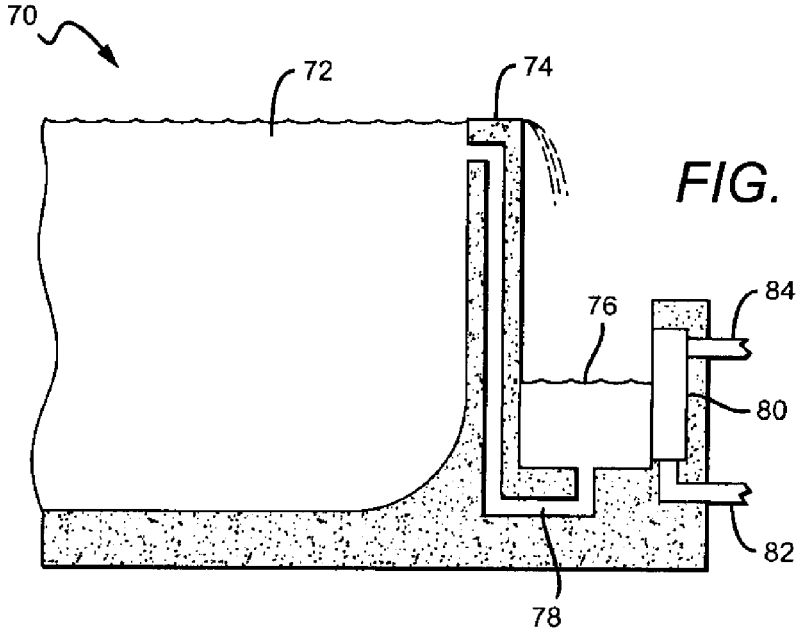
FIG. 6 is schematic side view of one embodiment of an infinity pool using a catch basin water level control system according to the present invention.

The control system 10 can be used in many different applications where it is desired to keep a body of water at a particular level. As described above, the control system is particularly adapted for use in catch basins for infinity pools and FIG. 6 shows a schematic view of one embodiment of an infinity pool 70 according to the present invention. The pool generally comprises a body of water 72 having an edge that terminates at a weir 74 to give the "infinity" effect. Water runs over the weir 74 into a catch basin 76, and the water can be circulated back to the body of water through a return conduit 78.

The pool 70 further comprises a water level control system mounted to a wall of the catch basin 76, and partially submerged in the water of the catch basin 76. The control system 80 is shown mounted to a particular wall, but it is understood that it can be mounted in many different locations. A water inlet conduit 82 is connected to the control system 80, preferably at its bottom inlet as described above. As the water level in the pool is lowered through transpiration or evaporation, the water level in the catch basis is also lowered. As described above, this will cause the control system to introduce water from the water inlet, into the catch basin 76, where it can recirculate back to the pool's body of water. If the basin overflows, either by malfunction of the system or by water being introduced to the basis from external sources such as rain, a water outlet conduit 84 is included to allow water out of the system 80.

Although the present invention has been described in considerable detail with reference to certain preferred configurations, other versions are possible. The invention can be used in spas, pools, tubs and the like. Different spa, pool or tub components can use the invention for water illumination. Therefore, the spirit and scope of the appended claims should not be limited to the preferred versions described above.

I claim:

1. A water level control system for controlling the level of water in a reservoir, comprising:

a system housing having a removable front plate having front plate openings, and a water inlet;

a removable mounting plate within said housing, said mounting plate removable from said housing when said front plate is removed;

a valve connected to said mounting plate, water from said reservoir entering said housing through said front plate openings, said valve operable to allow water to flow into said housing through said water inlet when water within said reservoir water falls below an adjustable desired level, and stopping said flow into said housing when said reservoir is at the adjustable desired level, wherein said housing further comprises housing mounting holes for mounting said system to a wall of said reservoir, wherein said front plate is flush with the surface of said wall when said housing is mounted in said wall.

2. The control system of claim 1, wherein said valve comprises a float valve.

3. The control system of claim 1, wherein said system can be mounted in a wall of said reservoir with water running between said housing and said reservoir through said front plate openings.

4. The control system of claim 1, wherein said housing further comprises a top outlet to allow water out of said housing.

5. The control system of claim 1, wherein said holes are arranged for connectors to pass through said holes and tie to rebar.

6. The control system of claim 1, further comprising a conduit between said water inlet and said valve.

7. The control system of claim 6, wherein said conduit comprises a connecting tube between said water inlet and said mounting plate.

8. The control system of claim 6, wherein said conduit allowing water to pass from said inlet into said valve, said water flow passing into said valve and then into said housing when said reservoir water is below a desired level.

* * * * *